United States Patent [19]

Wunderlich

[11] Patent Number: 4,842,335

[45] Date of Patent: Jun. 27, 1989

[54] P.V.C. SWIVEL BEACH CHAIR

[76] Inventor: Arthur K. Wunderlich, 221 Green Ave., Lansdowne, Pa. 19050

[21] Appl. No.: 238,265

[22] Filed: Aug. 26, 1988

[51] Int. Cl.[4] ..... A47C 1/02

[52] U.S. Cl. ..... 297/349; 297/457; 297/408; 297/433; 297/364; 403/96

[58] Field of Search ..... 297/457, 445, 454, 441, 297/443, 363, 364, 365, 368, 369, 349, 425, 408, 433; 403/205, 403, 382, 96, 92, 93

[56] References Cited

U.S. PATENT DOCUMENTS 4,363,561 12/1982 Hsieh ..... 403/92
4,583,758 4/1986 Runion et al. ..... 297/443 X
4,666,327 5/1987 Su ..... 403/96 X
4,693,512 9/1987 Hobson ..... 297/457 X
4,768,829 9/1988 Goldman ..... 297/349 X

*Primary Examiner*—Kenneth J. Dorner
*Assistant Examiner*—José V. Chen
*Attorney, Agent, or Firm*—Jerry T. Kearns

[57] ABSTRACT

A swivel beach chair is formed from connected segments of P.V.C. pipe. Foot, back and head rest portions of the chair are pivotally adjustable and various configurations of swivel bases are disclosed for mounting the chair for three hundred sixty degree rotation. An adjustable latching mechanism is disclosed for allowing selective adjustment of the pivotal foot, back and head rest portions of the chair.

2 Claims, 6 Drawing Sheets

P.V.C. SWIVEL BEACH CHAIR

BACKGROUND OF THE INVENTION

1. Field of the Invention

The present invention relates to swivel chairs, and more particularly pertains to a new and improved swivel beach chair formed from connected segments of P.V.C. pipe. Conventional forms of beach chairs are generally formed from wood or metal materials which are subject to degradation upon exposure to the sun and salt water. While chairs have previously been formed from P.V.C. pipe segments which are glued together, no suitable adjustment mechanisms have been provided which allows for pivotally adjustable leg, back and head rest portions and which allows three hundred sixty degree rotation of the chair. Additionally, these conventional forms of chairs are provided with integral covers or padded upholstery cushions which are difficult to remove or clean. In order to solve these problems, the present invention provides an improved P.V.C. swivel chair which utilizes an improved locking mechanism for enabling pivotal adjustment of leg, back and head rest portions to selected positions.

2. Description of the Prior Art

Various types of swivel chairs are known in the prior art. A typical example of such a swivel chair is to be found in U.S. Pat. No. 3,711,152, which issued to C. Sirpak et al on Jan. 16, 1973. This patent discloses a chair having a contoured portion defining a back rest and a seat. The seat has a central recess extending inwardly from its forward edge of a size and shape to accommodate the upper legs of a person. The contoured portion of the chair is pivotally suspended upon a support member which in turn is supported on a base. The contoured portion is adjustable to different heights with respect to the base and includes a frame and cushion supported by the frame. The chair may be provided with arm rests and lower leg rests. The contoured portion and the support member are adapted to swivel with respect to the base and a mechanism is provided to selectively prevent such swiveling. U.S. Pat. No. 3,718,365, which issured to C. Gibson on Feb. 27, 1973, discloses a seat attachment for boats. A generally rectangular frame is formed from tubular members upon which a molded seat is secured. C-clamps are provided at each corner of the frame for securement to the side walls of a boat. U.S. Pat. No. 3,724,896, which issued to E. Belk on Apr. 3, 1973, discloses a swivel chair adapted for use in recreational vehicles. The chair includes a mount for attachment to fixed structure of the vehicle for rotatably mounting a bottom frame to permit the chair to be swivelled about a generally vertical axis. A back frame is pivotally mounted to a relatively fixed portion of the bottom frame, and braces are attached between the back frame and a relatively movable portion of the bottom frame. A seat lock mechanism locks the fixed and movable portions of the bottom frame in the position of recline or tilt of the back frame to prevent movement of the seat back during a vehicle accident. U.S. Pat. No. 4,379,588, which issued to D. Speice on Apr. 12, 1983, discloses a revolving solar lounge chair which rotates in response to energization from the sun's rays. The solar lounger has a chaise type chair which is rotatably supported on a base. Photovoltaic solar cells are mounted on the chair and generate electrical energy in response to the sun's rays. The electrical energy is used to power a drive motor which causes the chair to rotate relative to the base. U.S. Pat. No. 4,544,202, which issued to T. Keaton on Oct. 1, 1985, discloses a semiautomatically actuated rotatable chair which can be rotated by the chair user from a sitting position. The chair is comprised of a base member disposed horizontally on the upper surface of a ring gear member. A rotatable member with a seat on its upper portion is disposed above the base member for rotation about the base member through a follower gear integrally secured on the lower surface of the upper member.

While the above mentioned devices are suited for their intended usage, none of these devices provide a swivel beach chair formed from P.V.C. pipe segments with a locking mechanism which allows selective adjustment of pivotal foot, back and head rest portions and provides a rotatable mount of a chair on a P.V.C. support base. Inasmuch as the art is relatively crowded with respect to these various types of swivel chairs, it can be appreciated that there is a continuing need for and interest in improvements to such swivel chairs, and in this respect, the present invention addresses this need and interest.

SUMMARY OF THE INVENTION

In view of the foregoing disadvantages inherent in the known types of swivel chairs now present in the prior art, the present invention provides an improved P.V.C. swivel beach chair. As such, the general purpose of the present invention, which will be described subsequently in greater detail, is to provide a new and improved P.V.C. swivel beach chair which has all the advantages of the prior art swivel chairs and none of the disadvantages.

To attain this, a representative embodiment of the concepts of the present invention is illustrated in the drawings and makes use of a stationary frame formed from connected P.V.C. pipe segments. A swivel support is mounted for rotation at a center portion of the stationary frame. A chair frame formed from interconnected P.V.C. pipe segments is mounted for rotation on the swivel unit. Foot, back and head rest portions of the chair frame are pivotally adjustable and are provided with locking mechanisms for locking each portion in a selected adjusted position. A removable canvas cover is provided for the chair frame, which may be easily removed for cleaning or to change to a different color of covering.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved P.V.C. swivel beach chair which has all the advantages of the prior art swivel chairs and none of the disadvantages.

It is another object of the present invention to provide a new and improved P.V.C. swivel beach chair which may be easily and efficiently manufactured and marketed.

It is a further object of the present invention to provide a new and improved P.V.C. swivel beach chair which is of a durable and reliable construction.

An even further object of the present invention is to provide a new and improved P.V.C. swivel beach chair which is susceptible of a low cost of manufacture with regard to both materials and labor, and which accordingly is then susceptible of low prices of sale to the consuming public, thereby making such swivel chairs economically available to the buying public.

Still yet another object of the present invention is to provide a new and improved P.V.C. swivel beach chair which provides in the apparatuses and methods of the prior art some of the advantages thereof, while simultaneously overcoming some of the disadvantages normally associated therewith.

Still another object of the present invention is to provide a new and improved P.V.C. swivel beach chair which provides a swivel mounting to allow for three hundred sixty degree rotation of the chair about a vertical axis.

Yet another object of the present invention is to provide a new and improved P.V.C. swivel beach chair which provides adjustable foot, back and head rest portions.

Even still another object of the present invention is to provide a new and improved P.V.C. swivel beach chair which is provided with an improved canvas covering configuration which allows easy removal and replacement.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
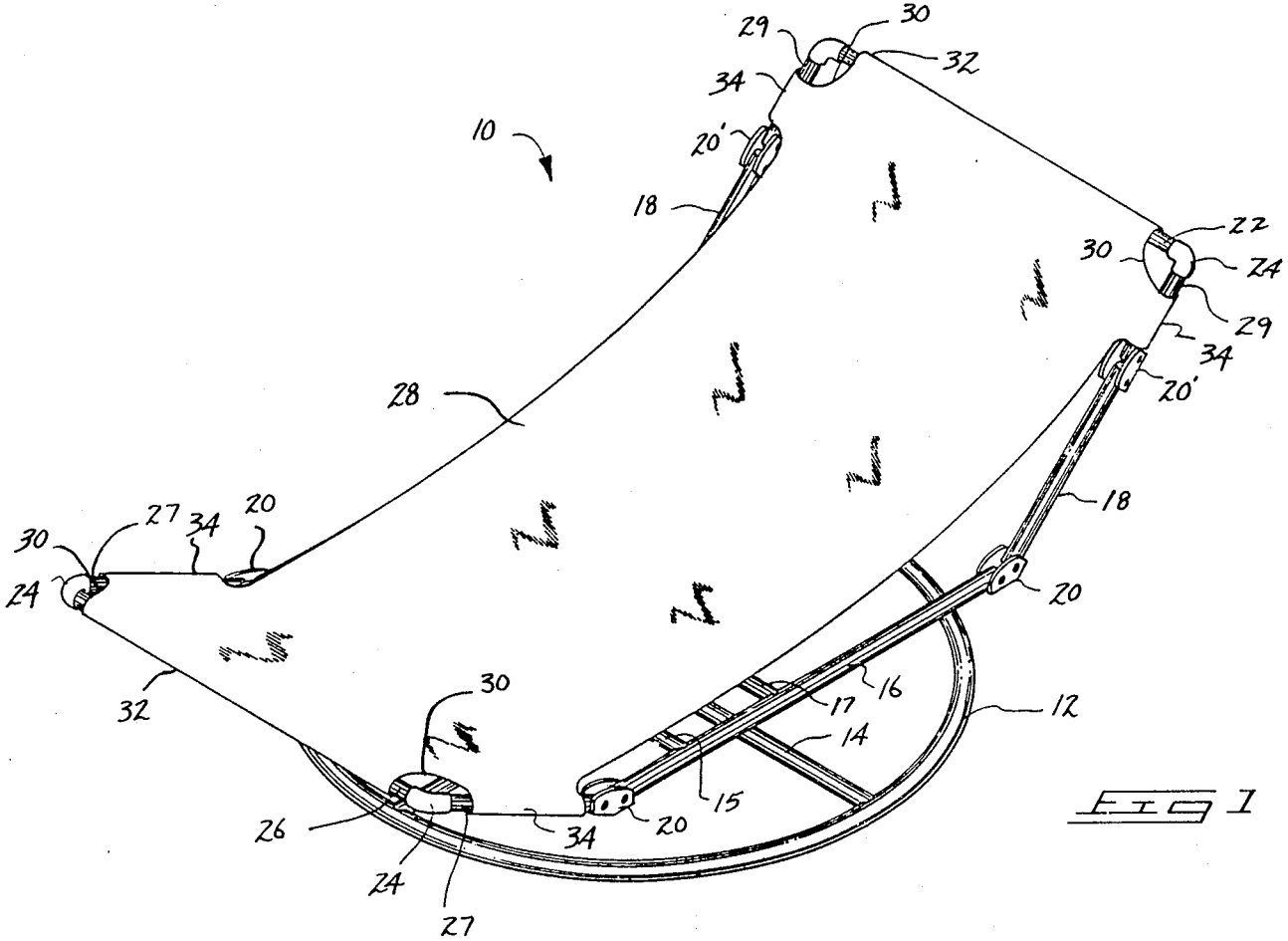
FIG. 1 is a perspective view of the P.V.C. swivel beach chair according to the present invention.

With reference now to the drawings, and in particular to FIG. 1 thereof, a new and improved P.V.C. swivel beach chair embodying the principles and concepts of the present invention and generally designated by the reference numeral 10 will be described.

More specifically, it will be noted that the first embodiment 10 of the invention includes a circular base 12 formed by interconnected arcuate P.V.C. pipe segments. A chair frame, also formed by interconnected P.V.C. pipe segments, is mounted for three hundred and sixty degree rotation about a vertical axis on the stationary circular base 12. The chair frame has parallel side rail members 16, each connected to a back support rail 18 by an angularly adjustable connector 20. Each of the back support rails 18 is connected to a head rest support rail 29 by a slightly modified form of angularly adjustable connector 20'. The upper free end of each of the head rest support rails 29 is connected by an elbow fitting 24 to an upper frame end bar 22. A seat reinforcement strut assembly includes transversely extending struts 15 and 17 which are connected between the parallel side support rails 16. The bottom end of each of the support rails 16 is connected by an angularly adjustable connector 20 to a leg support rail 27. The bottom end of each of the leg support rails 27 is connected by an elbow fitting 24 to a transversely extending lower frame end bar 26. A fabric cover 28, which is preferably formed from a brightly colored canvas or a suitable synthetic material, is stretched over the chair frame. The cover 28 is secured to the head rest support rails 29 by a pair of side loops 34. The side loops 34 may include VELCRO or snap fasteners to enable convenient removable and attachment of the cover 28. The top end of the cover 28 is secured by an end loop 32 around the upper frame end bar 22. The lower end of the fabric cover 28 is similarly secured by an end loop 32 around the lower frame end bar 26. A second pair of side loop fasteners 34 are secured around the leg support rails 27. This construction results in an arcuate open corner 30 at each corner of the cover 28. It should be noted that the cover 28 is stretched over the chair frame in a sling type fashion which causes an individual utilizing the chair to remain out of contact with the major portion of the chair frame. This results in an exceptionally comfortable sling type chair. Additionally, the cover 28 may be easily removed for washing or replacement with a different color of cover.

Figure 2:
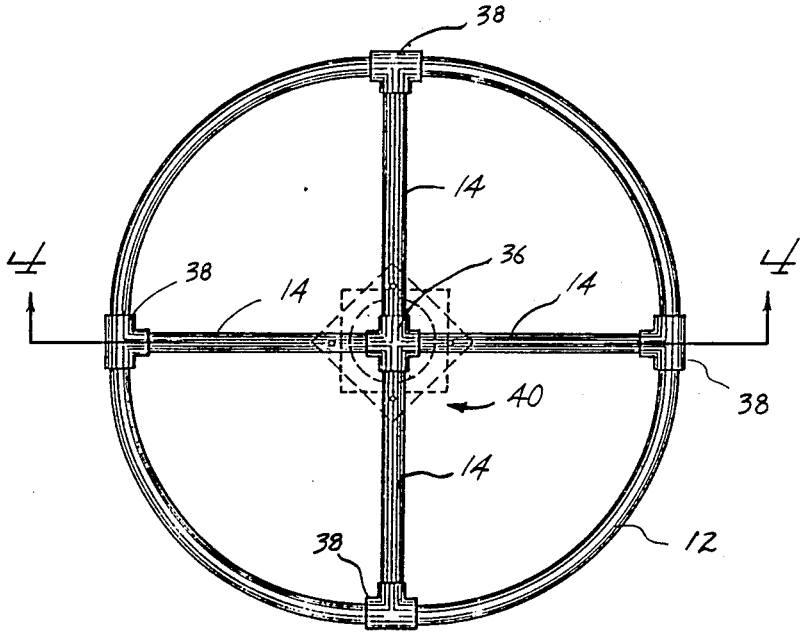
FIG. 2 is a top plan view of the stationary supporting base of the swivel beach chair of the present invention.

FIG. 2 provides a top plan view illustrating the constructional details of the stationary circular base 12. As previously mentioned, the base 12 is formed by four interconnected arcuate P.V.C. pipe segments. Ends of each adjacent pair of arcuate pipe segments are connected by a T fitting 38. A central fitting 36 has four connectors arranged at ninety degree intervals, and a strut 14 extends between each of the T fittings 38 and the central fitting 36. This provides a reinforcement cross within the circular base 12. A swivel base assembly 40 is mounted in overlying relation on the central fitting 36 and is secured to the reinforcement cross.

Figure 3:
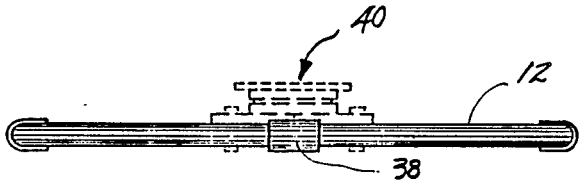
FIG. 3 is a side view of the stationary swivel base unit.

FIG. 3 provides a side view which illustrates the stationary circular base 12 with the swivel base assembly 40 illustrated in phantom.

Figure 4:
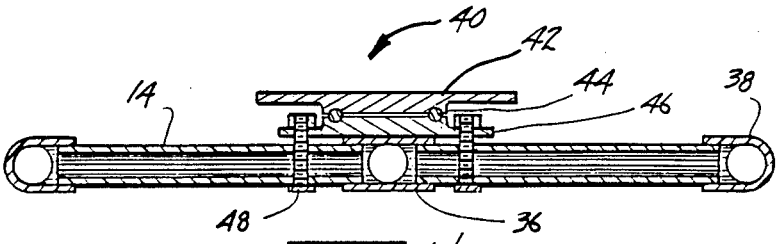
FIG. 4 is a transverse cross sectional view, taken along line 4—4 of FIG. 2, illustrating the constructional details of the swivel supporting unit.

FIG. 4 provides a transverse cross sectional view, taken along line 4—4 of FIG. 2, which illustrates the assembly details of the swivel base assembly 40. A stationary swivel base member 46 is secured by threaded fasteners 48 to the struts 14. A rotary swivel base member 42 is mounted for rotation about a vertical axis on the stationary member 46 by bearings 44.

Figure 5:
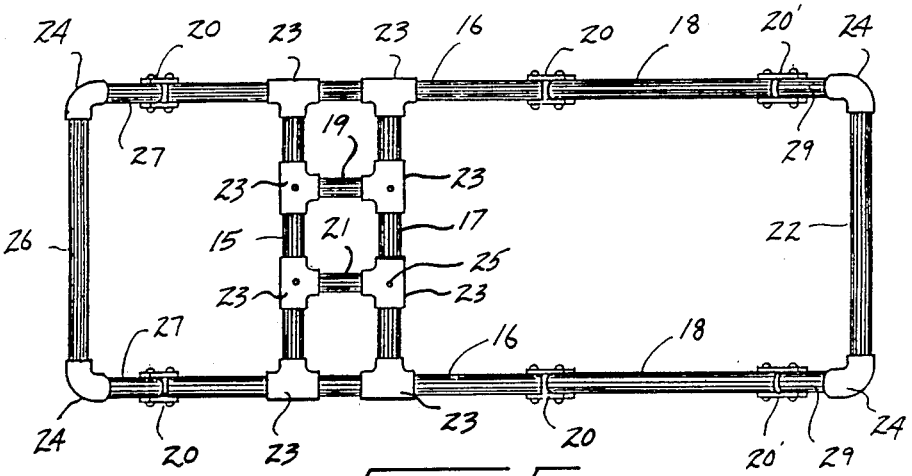
FIG. 5 is a top plan view of the chair frame of the P.V.C. swivel beach chair of the present invention.

FIG. 5 provides a top plan view which illustrates the constructional details of the chair frame with the fabric cover removed. As previously described, a seat reinforcement strut assembly extends transversely between the parallel side rail 16. The struts 15 and 17 are formed by interconnected pipe segments which include six T fittings 23. The four central T fittings 23 serve to mount longitudinally extending struts 19 and 21. The rotary swivel base member 42 (FIG. 4) is secured to the four central fittings 23 by cooperation with conventional threaded fasteners through the illustrated apertures 25. Thus, the chair frame is mounted for three hundred and sixty degree rotation about a vertical axis relative to the stationary base 12.

Figure 6:
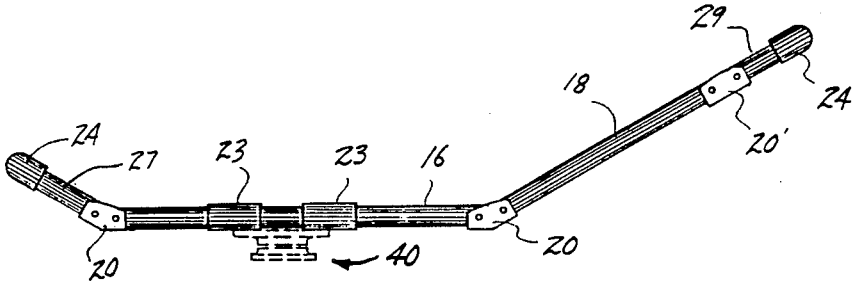
FIG. 6 is a side view of the chair frame of the P.V.C. swivel beach chair of the present invention.

FIG. 6 provides a side view of the chair frame, with the swivel base assembly illustrated in phantom lines.

Figure 7:
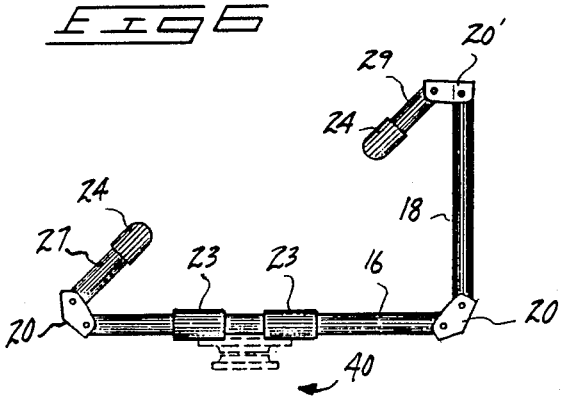
FIG. 7 is a side view of the chair frame of the swivel beach chair of the present invention, illustrating the range of adjustment of the foot, back and head rest portions.

FIG. 7 provides a side view similar to FIG. 6, which illustrates that the chair frame may be folded to a compact size for ease of storage and transportation.

Figure 8:
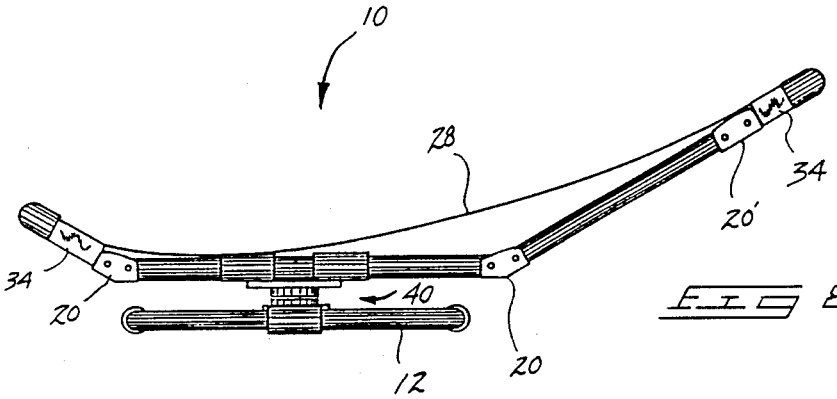
FIG. 8 is a side view of the P.V.C. swivel beach chair of the present invention, with the chair frame mounted on the swivel support base and with the canvas cover secured to the chair frame.

FIG. 8 provides a side view of the assembled swivel chair of the present invention. As previously mentioned, the fabric cover 28 is stretched in a sling type fashion across the chair frame.

Figure 9:
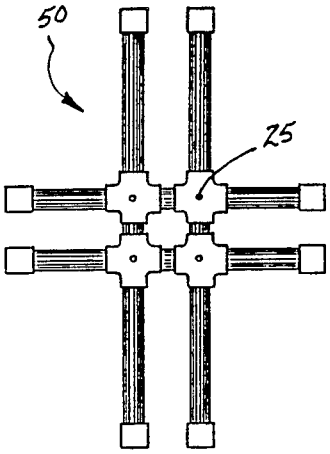
FIG. 9 is a top detail view of the swivel mounting portion of the chair frame.

FIG. 9 illustrates a first alternative construction 50 for the seat reinforcement strut assembly which may be utilized in place of the construction illustrated in FIG. 5.

Figure 10:
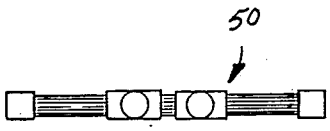
FIG. 10 is a side view of the swivel mounting portion of FIG. 9.

FIG. 10 provides a side view of the alternative seat reinforcement strut assembly of FIG. 9.

Figure 11:
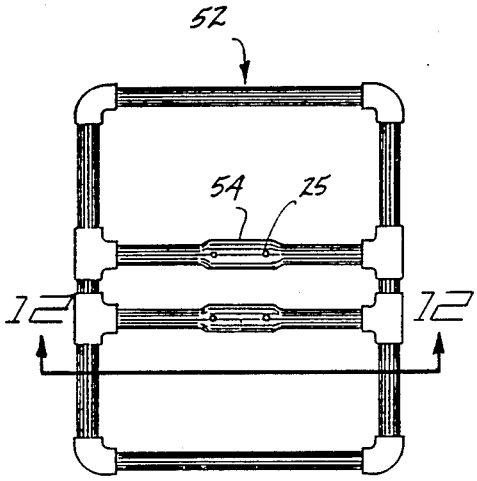
FIG. 11 is a top view of an alternative chair frame swivel mounting portion.

FIG. 11 depicts a second alternative seat reinforcement strut assembly which may also be utilized as an alternative construction to that illustrated in FIG. 5. In this alternative, the swivel base securing apertures 25 are provided in flattened portions 54 of transversely extending pipe segments.

Figure 12:
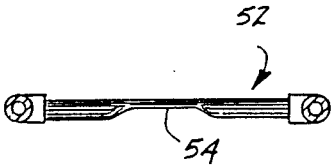
FIG. 12 is a side view of the alternative chair frame swivel mounting portion of FIG. 11.
Figure 13:
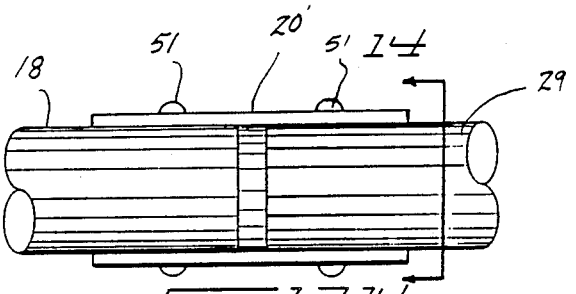
FIG. 13 is a top detail view illustrating a bracket for connecting P.V.C. pipe segments of the chair frame in fixed relation.
Figure 14:
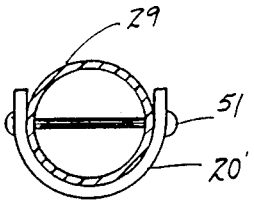
FIG. 14 is a transverse cross sectional view, taken along line 14—14 of FIG. 13.
Figure 15:
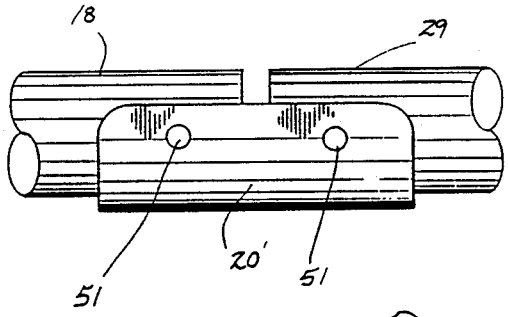
FIG. 15 is side view of the pipe segment connecting bracket of FIG. 13.

FIG. 12 provides a cross sectional view which illustrates the flattened portions 54.

FIGS. 13, 14, 15, 17 and 18 illustrate the angularly adjustable connector 20' which may be utilized to mount the back support rails 18 to the head rest support rails 29. As shown, the adjustable connector 20' includes a U-shaped channel member provided with transversely extending pivot pins 51. Each of these pivot pins 51 extends through one of two P.V.C. pipe segments to be pivotally connected.

Figure 16:
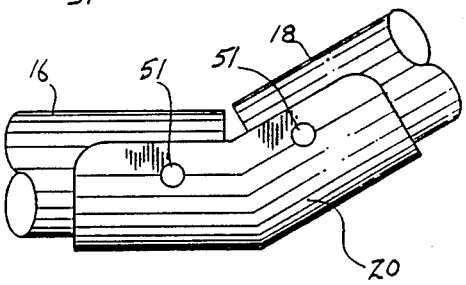
FIG. 16 is a side view of a modified angular pipe segment connecting bracket.
Figure 17:
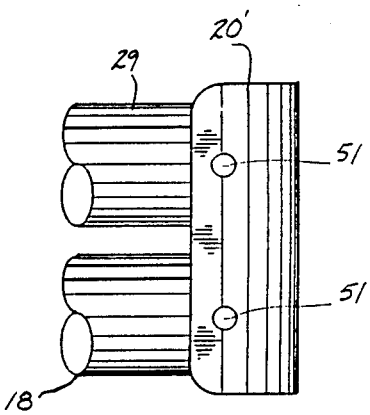
FIG. 17 is a modified connecting bracket which allows pivotal adjustment between two connected pipe segments.
Figure 18:
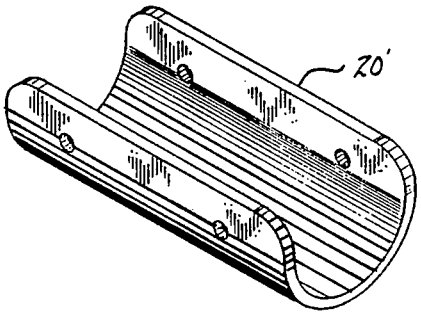
FIG. 18 is a perspective view of the bracket of FIG. 17.

In FIG. 16, the angularly adjustable connector 20 is illustrated which is similar to the connector 20', with the exception that the body of the connector 20 is bent into a shallow V configuration as illustrated. This provides a limiting action which determines the relative inclinations of the interconnected pipe segments 16 and 18.

Figure 19:
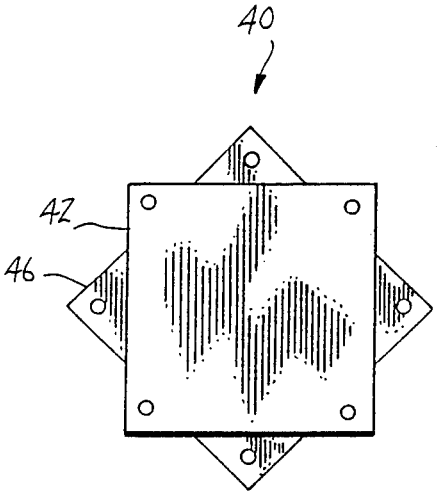
FIG. 19 is a top view of the swivel mounting unit.

FIG. 19 depicts a top view of the swivel base assembly 40.

Figure 20:
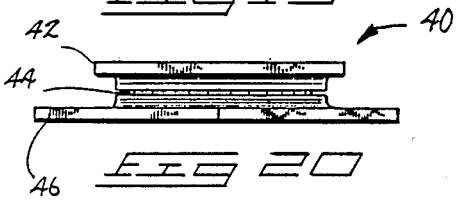
FIG. 20 is a side view of the swivel mounting unit.

FIG. 20 is a side view illustrating the swivel base assembly of FIG. 19.

Figure 21:
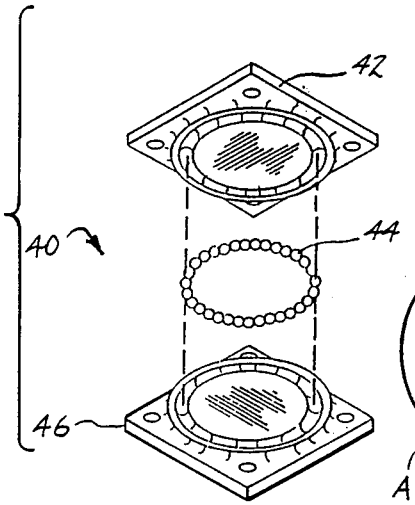
FIG. 21 is an exploded perspective view of the swivel mounting unit.

FIG. 21 is an exploded perspective view which illustrates the construction of the swivel base assembly 40. In place of the illustrated ball bearings 44, any other conventional form of bearings may be utilized, for example journal bearings or roller bearings.

Figure 22:
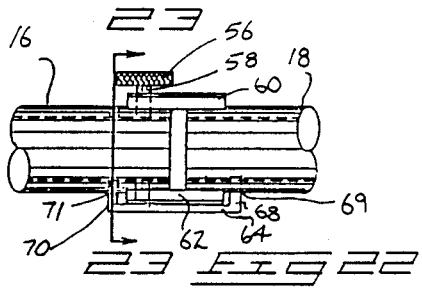
FIG. 22 is a top detail view illustrating the adjustable latching mechanism which allows selective pivotal adjustments of the foot, back and head rest portions of the chair frame.
Figure 23:
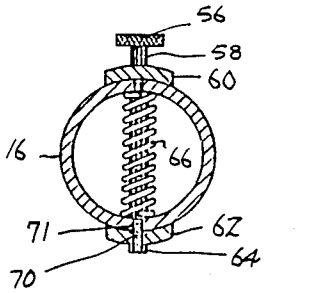
FIG. 23 is a cross sectional view, taken along line 23—23 of FIG. 22, illustrating the constructional details of the adjustable latching mechanism.
Figure 24:
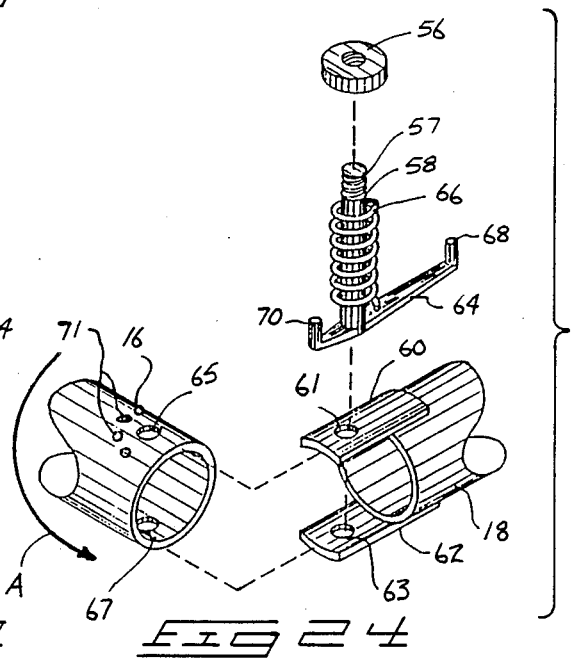
FIG. 24 is an exploded perspective view illustrating the adjustable latching mechanism.

FIGS. 22, 23 and 24 illustrate an alternative form of incrementally angularly adjustable connector which may be utilized in place of the previously described connectors 20 and 20'. A pair of elongated tabs 60 and 62 are secured at diametrically opposed location to an outer end surface at one end of a first pipe segment 18 to be connected. A lock aperture 69 is formed in the side wall of the pipe segment 18 adjacent one of the tabs 62. A pair of axially aligned apertures 61 and 63 are formed in the tabs 60 and 62. A pair of axially aligned axial holes 65 and 67 are formed through diametrically opposed points adjacent an outer end of the second pipe segment 16. For purposes of illustration, the pipe segment 16 in FIG. 24 has been rotated one hundred and eighty degrees from its assembled orientation, as indicated by arrow A. Thus, the aperture 65 is facing downwardly when the components are assembled. A plurality of indexed apertures 71 are formed in the second pipe segment 16 and are arranged in an arc about the axle hole 65. An elongated axle 58 extends through the aligned tab apertures 61 and 63 and also through the axle holes 65 and 67. Thus, the first 18 and second 16 pipe segments are pivotally connected by the axle 58. A transversely extending locking bar 64 is connected at one end of the axle 58. A first projection 70 at one end of the locking bar 64 is provided for engagement with one of the index apertures 71. A second projection 68, at an opposite end of the locking bar 64, is provided for engagement with the lock aperture 69 in the pipe segment 18 (FIG. 22). A coil spring 66 has one end connected to the axle 58 and an opposite end which, in an assembled condition, abuts the interior side wall of the pipe segment 16 as shown in FIG. 23. The coil spring 66 serves to bias the locking bar 64 into engagement with one of the index apertures 71 and also into engagement with the lock aperture 69. A knob 56 is connected by threads 57 to one end of the axle 58 opposite the locking bar 64 for manually moving the locking bar 64 out of engagement with the index 71 and lock 69 apertures, against the bias of the spring 66. Thus, the relative inclinations of the pipe segments 16 and 18 may be incrementally angularly adjusted by selective engagement of the projection 70 of the locking bar 64 with one of the arcuately arrayed index apertures 71.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A polyvinylchloride swivel beach chair, comprising:

a circular base formed by four interconnected arcuate polyvinylchloride pipe segments;

ends of each adjacent pair of arcuate pipe segments connected by a T fitting;

a central fitting having four connectors arranged at ninety degree intervals;

a strut extending from each of said four connectors to one of said T fittings, forming a reinforcement cross within said circular base;

a stationary swivel base overlying said central fitting and secured to said reinforcement cross;

a rotary swivel base mounted by bearings for rotation on said stationary swivel base;

a chair frame formed from interconnected polyvinylchloride pipe segments including a seat frame portion having parallel side rail members;

a seat reinforcement strut assembly extending between said side rail members;

said strut assembly secured for rotation on said rotary swivel base;

a pair of parallel leg support rails, each secured by an angularly adjustable connector to one of said side rail members;

a lower frame end bar having opposite ends attached to one of said leg support rails;

a pair of parallel back support rails, each secured by an angularly adjustable connector to one of said side rail members;

a pair of parallel head rest support rails, each secured by an angularly adjustable connector to one of said back support rails;

an upper frame end bar having opposite ends attached to one of said head rest support rails;

a fabric cover over said chair frame, an upper end of said cover attached to said head rest support rails and said upper frame end bar, a lower end of said cover attached to said leg support rails and said lower frame end bar, whereby said cover is suspended over said chair frame;

each of said angularly adjustable connectors being incrementally adjustable and comprising a pair of elongated tabs secured at diametrically opposite locations through an outer end surface at one end of a first pipe segment to be connected;

a lock aperture in said first pipe segment adjacent one of said tabs;

a pair of axially aligned apertures in said tabs;

a pair of axially aligned axle holes formed through diametrically opposed points adjacent an outer end of a second pipe segment to be connected;

a plurality of index apertures in said second pipe segments arranged in an arc about one of said axle holes;

an elongated axle extending through said aligned tab apertures and through axle holes and pivotally connecting said first and second pipe segments;

a transversely extending locking bar connected at one end of said axle, said locking bar having a first projection at one end for engagement with one of said index apertures and a second projection at an opposite end for engagement with said lock aperture;

a coil spring around said axle and within said second pipe segment biasing said locking bar into engagement with said index and lock apertures; and a knob at an end of said axle opposite said locking bar for manually moving said locking bar out of engagement with said index and lock apertures.

2. In a chair having a frame formed from a plurality of connected pipe segments and having at least one incrementally angularly adjustable frame portion including first and second adjustably connected pipe segments, the improvement comprising:

a pair of elongated tabs secured at diametrically opposite locations through an outer end surface at one end of said first pipe segment to be connected;

a lock aperture in said first pipe segment adjacent one of said tabs;

a pair of axially aligned apertures in said tabs;

a pair of axially aligned axle holes formed through diametrically opposed points adjacent an outer end of said second pipe segment to be connected;

a plurality of index apertures in said second pipe segments arranged in an arc about one of said axle holes;

an elongated axle extending through said aligned tab apertures and through said axle holes and pivotally connecting said first and second pipe segments;

a transversely extending locking bar connected at one end of said axle, said locking bar having a first projection at one end for engagement with one of said index apertures and a second projection at an opposite end for engagement with said lock aperture;

a coil spring around said axle and within said second pipe segment biasing said locking bar into engagement with said index and lock apertures; and a knob at an end of said axle opposite said locking bar for manually moving said locking bar out of engagement with said index and lock apertures.

* * * * *